US005716746A

United States Patent [19]

Mikuriya et al.

[11] Patent Number: 5,716,746

[45] Date of Patent: Feb. 10, 1998

[54] MAGNETIC TONER AND PROCESS FOR PRODUCING MAGNETIC TONER

[75] Inventors: Yushi Mikuriya, Kawasaki; Toshiaki Nakahara, Tokyo; Masayoshi Shimamura, Kawasaki; Kuniko Kobayashi, Koganei; Kazuyoshi Hagiwara, Tokyo; Masami Fujimoto, Yokohama, all of Japan

[73] Assignee: Canon Kabushiki Kaisha, Tokyo, Japan

[21] Appl. No.: 247,453

[22] Filed: May 23, 1994

Related U.S. Application Data

[63] Continuation of Ser. No. 899,242, Jun. 16, 1992, abandoned.

[30] Foreign Application Priority Data

Jun. 19, 1991 [JP] Japan ..... 3-147392

[51] Int. Cl.[6] ..... G03G 9/083

[52] U.S. Cl. ..... 430/106.6; 430/109; 430/137

[58] Field of Search ..... 430/106.6, 109, 430/904, 137

[56] References Cited

U.S. PATENT DOCUMENTS

| | | | |
|---|---|---|---|
| 2,297,691 | 10/1942 | Carlson | 95/5 |
| 4,499,168 | 2/1985 | Mitsuhashi | 430/99 |
| 4,792,513 | 12/1988 | Gruber et al. | 430/109 |
| 4,797,344 | 1/1989 | Nakahara et al. | 430/138 |
| 4,857,432 | 8/1989 | Tanikawa et al. | 430/106 |
| 4,917,984 | 4/1990 | Saito | 430/109 |
| 4,939,060 | 7/1990 | Tomiyama et al. | 430/106.6 |
| 4,966,829 | 10/1990 | Yasuda et al. | 430/109 |
| 5,077,168 | 12/1991 | Ogami et al. | 430/109 |
| 5,135,833 | 8/1992 | Matsunaga et al. | 430/904 |
| 5,240,805 | 8/1993 | Asada et al. | 430/109 |

FOREIGN PATENT DOCUMENTS

| | | |
|---|---|---|
| 0259819 | 3/1988 | European Pat. Off. . |
| 0331393 | 9/1989 | European Pat. Off. . |
| 0332212 | 9/1989 | European Pat. Off. . |
| 0438181 | 7/1991 | European Pat. Off. . |
| 0468494 | 1/1992 | European Pat. Off. . |
| 42-23910 | 11/1967 | Japan . |
| 43-24748 | 10/1968 | Japan . |
| 62-195683 | 8/1987 | Japan . |
| 63-32182 | 6/1988 | Japan . |
| 2213282 | 8/1989 | United Kingdom . |

OTHER PUBLICATIONS

Patent Abstracts of Japan, vol. 12, No. 460 (P-795) <3307>Dec 5, 1988.

*Primary Examiner*—Christopher D. Rodee

*Attorney, Agent, or Firm*—Fitzpatrick, Cella, Harper & Scinto

[57] ABSTRACT

A magnetic toner which is excellent in the low temperature fixability and the anti-offset properties is disclosed. The binder resin of the toner comprises a non-crosslinked styrene polymer, a non-crosslinked styrene copolymer or a mixture of these, and a polyolefin, wherein;

the binder resin has, in its molecular weight distribution pattern measured by gel permeation chromatography (GPC), at least one maximal point (peak) in each region of a low molecular weight of from 5,000 to 20,000 and of a high molecular weight of from 200,00 to 1,000,000, where a height H1 of a maximum peak in the low molecular weight region, a height H3 of a maximum peak in the high molecular weight region and a height H2 of a minimal point between both of said peaks satisfy the relationship H1:H2:H3 of 3–25:1:1.5–12; and has a weight average molecular weight Mw and a number average molecular weight Mn in a value Mw/Mn of from 15 to 80.

20 Claims, 2 Drawing Sheets

MAGNETIC TONER AND PROCESS FOR PRODUCING MAGNETIC TONER

This application is a continuation of application Ser. No. 07/899,242 filed Jun. 16, 1992 abandoned.

BACKGROUND OF THE INVENTION

1. Field of the Invention

The present invention relates to a magnetic toner for developing an electrostatic image, used in an image forming process such as electrophotography, electrostatic recording or electrostatic printing, and a process for producing the magnetic toner.

2. Related Background Art

In electrophotography, a number of methods are known as disclosed in U.S. Pat. No. 2,297,691, Japanese Pat. Publications No. 42-23910 and No. 43-24748 and so forth. In general, copies are obtained by forming an electrostatic latent image utilizing a photoconductive material according to various means on a photosensitive member, subsequently developing the latent image by the use of a toner to form a toner image, and transferring the toner image to a transfer medium such as paper if necessary, followed by fixation with heat, pressure, heat-and-pressure, or solvent vapor. The toner remaining on the photosensitive member is removed by various means, and then the above process can be repeated.

In recent years, such a copying apparatus is not only used as a copying machine for office work to take copies of originals, but also has begun to be used as an information output machinery connected with other information processors since the introduction of digital techniques, or as a printer for making fresh originals because the multifunctionalization has made it easy to process or edit image information. There is also an increasing use as a personal printer for private use.

Under such circumstances, for the copying and printing apparatus, high-speed, high image quality, compact size and light weight have been pursued, as well as extremely high reliability. Meanwhile, in order to obtain lower cost, copying machines and printers are now comprising more simple components in various respects. As a result, the requirement for the toner performance has become higher and higher, because, without the improvement of the toner performance excellent electrophotographic apparatus are not able to work as desired.

For example, for fixing the toner image onto the recording medium such as paper, various methods have been developed. At present the pressure heat system is most common, where the heat roller fixing system is widely used.

The heat roller fixing system is a method comprising of bringing a toner image on the surface of a recording medium in contact with the surface of a heat roller, where the roller's surface consists of a material having releasability to toner, and applying heat and pressure during the passage. Since in this method the surface of the heat roller comes into contact with the toner image on the recording medium under pressure, a very good thermal efficiency can be achieved when the toner image is melt-adhered onto the recording medium, so that fixing can be carried out rapidly.

In the heat roll fixing, however, a waiting time is necessary for the heat roller to reach a given temperature. As it is attempted to shorten this waiting time, and copying machines are made more speedy, the time for a toner image fixation on recording medium becomes shorter. Accordingly, the temperature of the fixing roller may fall when the recording medium passes and faulty fixation tends to occur.

In addition, as the surface of the heat roller comes into contact with the toner image under application of pressure, part of the toner image may transfer and adhere to the surface of the fixing roller, which is re-transferred to the subsequent recording medium causing an offset phenomenon.

Thus, in order to achieve a shorter waiting time, a higher fixing speed and a higher image quality while maintaining a good fixing performance of toner visible images to recording mediums without no image stain due to the offset phenomenon, it is important for toners to have low-temperature fixing performance and anti-offset properties.

For the purpose of improving the low-temperature fixing performance and fluidity of toners or the contamination resistance of toner bearing members such as photosensitive members, a proposal is made in Japanese Pat. Publication No. 63-32182. This publication discloses a toner whose binder resin component is a vinyl polymer having in its molecular weight distribution pattern at least one peak each in each specific region of low molecular weight end high molecular weight. This toner contains the low molecular weight component in comparatively large quantity to improve its fixing performance. Further studies made by the present inventors, however, have revealed that many components not effectively contributing to the fixing performance are present, and whose molecular weights distribute between both peaks in the low molecular weight region and the high molecular weight region. Thus, there remains some room for further improvement not only in fixing performance but also in anti-offset properties.

Meanwhile, as a measure to solve the offset phenomenon problem, it is known to add a release agent such as a low molecular weight polyethylene or low molecular weight polypropylene to a toner. It, however, is usually difficult to produce a toner containing a release agent in an optimum state. In the manufacture of conventional toners, a binder resin, a colorant such as a magnetic material, optionally together with other additives, and a release agent are premixed. Thereafter the mixture is heated and melt-kneaded, and the kneaded product is cooled, followed by the steps of pulverization and classification to give a toner with the desired particle diameter. In such a manufacturing method, however, the binder resin shows poor compatibility with the release agent at the stage of heating and melt-kneading so that particles mainly composed of the release agent are produced at the stage of pulverization, and it is difficult to obtain a toner containing a release agent uniformly dispersed in the resulting toner particles. Moreover, if at the stage of pulverization, particles solely consisting of the release agent and particles mainly composed of the release agent tend to be produced, it means that a lot of particles of the release agent are present apart from the toner particles, and the resulting toner tends to have a low release effect.

The above Japanese Patent Publication No. 63-32182 also discloses a toner in which an ethylene type olefin homopolymer or copolymer, that can serve as a release agent, is incorporated by kneading. This toner, however, comprises a binder resin containing a low molecular weight component in a relatively large quantity, so that it is difficult to apply sufficient shear force when the ethylene type olefin polymer and other components are melt-kneaded, often resulting in the poor dispersion of the polymer in toner particles. Even if the release agent is well dispersed and mixed in the toner particles, the combination of such binder resin and the release agent is not still satisfactory for fixing performance and anti-offset properties, therefore, it cannot be said that releasability according to the release agent is fully demonstrated.

In order to effect the releasability of the toner, the release agent may be added in a large quantity. This, however, causes a further increase in the free particles of release agent among toner particles. If such a toner is used in a copying machine, its fluidity in a developing assembly may become poor, the surfaces of carrier particles and a toner carrying member such as a developing sleeve may be stained or the toner tends to adhere to non-image areas during development. These may cause a difficulty such as filming on the photosensitive member and hence poor developed images tend to be produced.

For the purpose of uniformly dispersing a release agent in a toner, a proposal has been hitherto made in Japanese Patent Publication No. 62-195683. According to this proposal, a low molecular weight wax is mixed in a binder resin solution followed by removal of the solvent with heating, and the resulting binder resin is used to give a toner improved in dispersion of the wax in toner particles. In this toner, the binder resin has a weight average molecular weight (Mw) of not more than 23,000, that is, comprised of a polymer with a very low molecular weight. Further studies by the present inventors, however, have revealed that when the binder resin containing no high molecular weight component and comprised of only a low molecular weight component as in said binder resin is used, the increase in viscosity during removal of the solvent in the binder resin solution in which the wax has been mixed is low, so that after the removal of the solvent or after the subsequent step of cooling the binder resin, the low molecular weight wax tends to again agglomerate into large particles and precipitate in the binder resin because of its poor compatibility. Thus there remains some room for further improvement in dispersion of the release agent in such toner particles. Moreover, since the toner containing such a binder resin contains no high molecular weight component, the elasticity of the melted toner at fixing is so low that it is difficult to achieve the anti-offset properties of a higher level.

SUMMARY OF THE INVENTION

An object of the present invention is to solve the problems as discussed above.

Another object of the present invention is to provide a magnetic toner having superior low-temperature fixing performance and anti-offset properties.

Still another object of the present invention is to provide a magnetic toner having superior anti-blocking properties.

A further object of the present invention is to provide a magnetic toner containing minor, if any, free fine particles of olefin among magnetic toner particles.

A still further object of the present invention is to provide a magnetic toner having a superior durability.

A still further object of the present invention is to provide a magnetic toner that may to a lessor extent cause the staining of the surface of a developing sleeve and the surface of a photosensitive drum.

The above objects of the present invention can be achieved by a magnetic toner comprising a binder resin and a magnetic material, said binder resin comprising a non-crosslinked styrene polymer, a non-crosslinked styrene copolymer or a mixture of these, and a polyolefin, wherein;

said binder resin has a molecular weight distribution pattern measured by gel permeation chromatography (GPC), in which at least one peak (maximal point) is present in each region of a low molecular weight of from 5,000 to 20,000 and of a high molecular weight of from 200,000 to 1,000,000, where the height H1 of the highest peak P1max in the low molecular weight region, the height H3 of the highest peak P3max in the high molecular weight region and the height H2 of the minimal point V2 min between both of said peaks satisfy the relationship H1:H2 :H3 of 3–25:1:1.5–12; and has a weight average molecular weight Mw and a number average molecular weight Mn with a ratio Mw/Mn of from 15 to 80.

DESCRIPTION OF THE PREFERRED EMBODIMENTS

Figure 1:
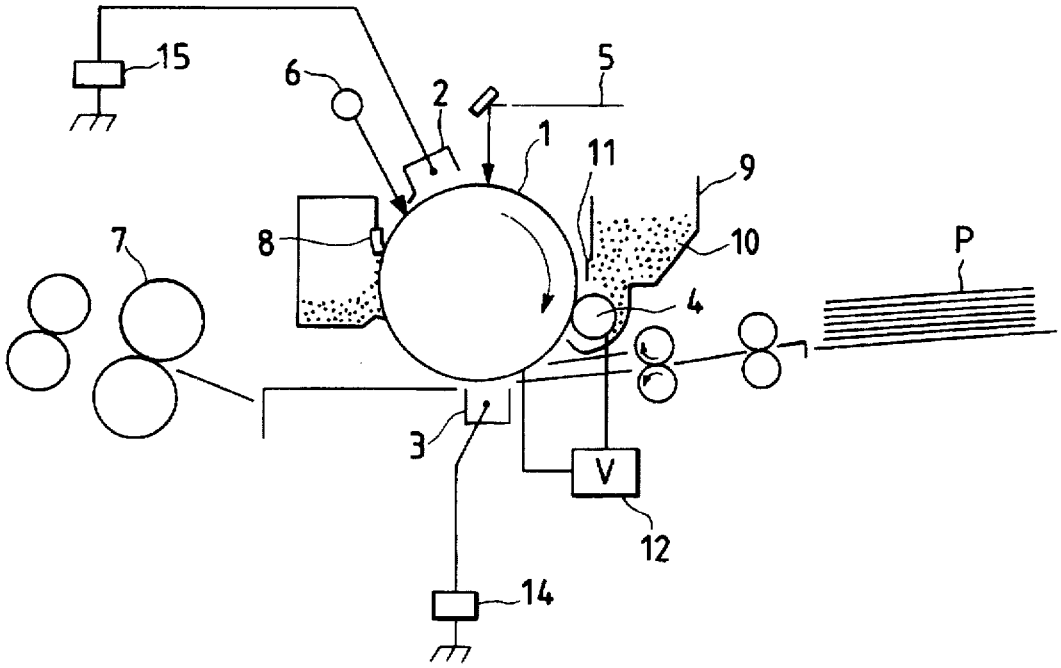
FIG. 1 is a schematic structural view to illustrate an image forming process to which the magnetic toner of the present invention can be applied.

The present inventors have discovered that, in order to impart a superior low-temperature fixing performance to a toner concomitantly with anti-offset properties, the molecular weight distribution of a binder resin must be controlled so that the binder resin can effectively permit these performance and properties, and at the same time a release agent must be contained in the toner so that it can effectively allow the performance and properties. However in the conventional toners, the ineffective components not contributing to the fixing performance are superflously present, and their molecular weights are between both peaks in low and high molecular weight regions in molecular weight distribution pattern of the binder resin. The uniform dispersibility of the release agent also not yet been well settled. Research has been done in this regard, and the result is the present invention.

The reason why the magnetic toner of the present invention can achieve the objects stated above is considered as follows: The binder resin contained therein is comprised of a non-crosslinked polymer so that the molten toner has a low viscosity to promote its low-temperature fixing performance. By setting the value of Mw/Mn in the molecular weight distribution of the binder resin larger, the melt elasticity of the toner can be increased, thereby ensuring anti-offset properties. Also in the molecular weight distribution pattern, the height H2 at the minimal point V2 min between the maximal peaks P1max and P3max in low and high molecular weight regions respectively, is controlled to be small so that the components not contributing to the fixing performance can be reduced. Thus the whole constituents over the whole molecular weight distribution range in the resin can effect the fixing performance and anti-offset properties. As a result, the magnetic toner of the present invention has an improved low-temperature fixing performance and anti-offset properties. In addition, when a polyolefin is added to the binder resin as a release agent, previously in the presence of the components of the high molecular weights, the release agent is not liable to re-agglomerate after dispersion and precipitation occurs in very small particles which are uniformly dispersed, so that the free particles of release agent, if any, occurs in a very small quantity. Hence, the anti-blocking properties, fluidity, durability and the steady image formation can be achieved.

It is required for the binder resin used in the present invention to be a non-crosslinked polymer, and to have, in its molecular weight distribution pattern measured by gel permeation chromatography (GPC), at least one peak (maximal point) in each region of the low molecular weight of from 5,000 to 20,000 and the high molecular weight of from 200,000 to 1,000,000, where the height H1 of the higheast peak P1max in the low molecular weight region, a height H3 of the highest peak P3max in the high molecular weight region and a height H2 of the minimal point V2min between both of said peaks satisfy the relationship H1:H2:H3 of 3–25:1:1.5–12; and to have a weight average molecular weight Mw and a number average molecular weight Mn in a value Mw/Mn of from 15 to 80, and to further contain a polyolefin. Preferably in the molecular weight distribution pattern measured by GPC, the binder resin may have at least one peak each in the region of a low molecular weight of from 8,000 to 16,000 and the region of a high molecular weight of from 400,000 to 800,000, where the height H1 of the highest peak P1max in the low molecular weight region, the height H3 of the highest peak P3max in the high molecular weight region and the height H2 of the minimal point V2min between both of said peaks satisfy the relationship H1:H2:H3 of 6–20:1:3–9; and have a weight average molecular weight Mw and a number average molecular weight Mn in a ratio (Mw/Mn) of from 22 to 60.

More preferably, in the molecular weight distribution pattern measured by GPC, the height H1 may be higher than the height H3. Still more preferably, the high molecular weight components present in the region of a molecular weight of not less than 500,000 may be contained in an amount of from 5% to 30%, and preferably from 7% to 25%. A binder resin satisfying these conditions is preferable for the good achievement of both the fixing performance and anti-offset properties.

If, in the molecular weight distribution pattern measured by GPC of the binder resin, the peak in the low molecular weight region is present at the molecular weight less than 5,000, the anti-blocking properties of the toner may be lowered often causing staining of the toner carrying member such as a developing sleeve as well as fogging during development. On the other hand, if the peak in low molecular weight region is present at the molecular weight more than 20,200, the low-temperature fixing performance may become undesirably poor. If the molecular weight of the peak in the high molecular weight region is less than 200,000, the anti-blocking properties and anti-offset properties may be lowered. On the other hand, when the molecular weight of the peak in the high molecular weight region is more than 1,000,000, the viscosity begins to increase when the toner is melted, making the low-temperature fixing performance undesirably poor. If the height H1 of the peak in the low molecular weight region is less than 3 or the height H3 of the peak in the high molecular weight region is more than 12, the low-temperature fixing performance may become poor undesirably. On the other hand, if the H1 is more than 25 or the H3 is less than 1.5, the anti-offset properties and the dispersibility of the release agent may become undesirably poor. If the weight average molecular weight/number average molecular weight (Mw/Mn) is less than 15, the anti-offset properties begin to deteriorate, end if it is more than 80, the low-temperature fixing performance begins to deteriorate undesirably.

The binder resin of the present invention may preferably be prepared by a process comprising dissolving a low molecular weight polymer in a good solvent, wherein the low molecular polymer has the molecular weight distribution pattern measured by GPC, in which the highest peek is present in the region of a molecular weight of from 5,000 to 20,000 and having a value Mw/Mn of not more then 3.0, to give a polymer solution, alternatively the solution may be prepared by conducting solution polymerization to prepare a solution of such low molecular weight polymer; introducing in the resulting solution a high molecular weight polymer end e polyolefin, the high molecular weight polymer having the highest distribution peak in the region of the molecular weight of from 200,000 to 1,000,000 and containing not more than 30% by weight of components having the molecular weight of from 500 to 100,000; dissolving them while heating; and removing the solvent.

The high molecular weight polymer may preferably be a polymer containing from 40% to 80% of components having a molecular weight of not less than 500,000.

The low molecular weight polymer as described above can be obtained by any of solution polymerization, suspension polymerization, bulk polymerization and emulsion polymerization. Taking account of the subsequent step of obtaining the solution of the low molecular weight polymer, the low molecular weight polymer may preferably be prepared by solution polymerization so that the solution or solvent for solution polymerization can be used in the next step. The solvent used in such solution polymerization may include hydrocarbon type organic solvents such as benzene, xylene and cyclohexane; ketone type organic solvents such as acetone, methyl ethyl ketone, methyl isobutyl ketone and cyclohexanone; and amide type organic solvents such as dimethylformamide and dimethylacetamide. Any of these solvents can be used also as the good solvent used when the low molecular weight polymer is dissolved to give the polymer solution.

An initiator used to polymerize polymerizable monomers may include radical initiators as exemplified by t-butyl peroxy-2-ethylhexanoate, t-butyl peroxylaurate, benzoyl peroxide, lauroyl peroxide, octanoyl peroxide, di-t-butyl peroxide, t-butyl cumylperoxide, diisopropylbenzene hydroperoxide, p-methane hydroperoxide, 2,2'-azobisisobutyronitrile, 2,2'-azobis(2-methylbutyronitrile) and 2,2'-azobis(4-methoxy2,4-dimethylvaleronitrile), which may be used alone or in the form of a mixture. The radical polymerization initiator may suitably be used in an amount of from 0.1% to 15% by weight, and preferably from 1% to 10% by weight.

As for the high molecular weight polymer satisfying the molecular weight condition as described above, it can be obtained by a method in which a polymerization initiator for polymerizable monomers is selected so that the production of polymers having a molecular weight of not more than 100,000 is inhibited during synthesis, a method in which polymers having the molecular weight of not more than 100,000 are fractionated and removed so that the content of the polymers having a molecular weight of not more than 100,000 can be reduced, or using both of these methods in combination.

The polymerization may be carried out by any of bulk polymerization, solution polymerization, suspension polymerization and emulsion polymerization. The suspension polymerization is preferred, by which a high polymer can be relatively readily obtained and in which the molecular weight distribution can be readily controlled.

As the initiator for polymerizing polymerizable monomers, a bifunctional radical initiator should be used, which may include bifunctional radical initiators as exemplified by 1,1-bis(t-butylperoxy)-3,3,5-trimethylcyclohexane, 1,1-bis(t-butylperoxy)cyclohexane, 1,4-bis(t-butylperoxycarbonyl)cyclohexane, 2,2-bis(t-butylperoxy)octane, n-butyl-4,4-bis(t-butylperoxy) valylate, 2,2-bis(t-butylperoxy)butane, 1,3-bis(t-butylperoxy-isopropyl)benzene, 2,5-dimethyl-2,5-di(t-butylperoxy) hexyne-3, 2,5-dimethyl-2,5-di(t-benzoylperoxy)hexane, di-t-butyl peroxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butyl peroxycarbonate) and di-t-butyl peroxytrimethyladipate. Any of these can be used alone or in the form of a mixture, or may be used optionally in combination with other radical initiators. These radical polymerization initiators may be used in an amount of from 0.05% to 5% by weight, and preferably from 0.1% to 3% by weight, based on the weight of polymerizable monomers that constitute the high molecular weight polymer.

The polymer components can be fractionated by a method including fractional precipitation, fractional dissolution, column fractionation and GPC. In particular, it is preferred to reduce the content of the polymer with a molecular weight of not more than 100,000 by fractional precipitation. A solvent used to dissolve the high molecular weight polymer by fractional precipitation may include hydrocarbon type solvents such as benzene, xylene and cyclohexane; ketone type solvents such as acetone, methyl ethyl ketone and cyclohexane; and ether type solvents such as tetrahydrofuran and methyl cellosolve. A solvent used to again separate and precipitate the high molecular weight polymer from the solution in which polymers have been dissolved may include alcohol type solvents such as methanol, ethanol and isopropyl alcohol.

The binder resin used in the present invention is comprised of a styrene polymer or a styrene copolymer. As the low molecular weight polymer, a styrene polymer or styrene copolymer having from 75% to 100% by weight of styrene component is preferable in view of developing performance, heat-fixing performance and anti-offset properties. More preferably a styrene copolymer having from 80% to 95% by weight of styrene component should be used.

The high molecular weight polymer may preferably be a styrene copolymer having from 60% to 99% by weight (preferably from 70% to 90% by weight) of styrene component.

Monomers for synthesizing the styrene polymer may include styrenes as exemplified by styrene, α-methylstyrene, vinyltoluene and chlorostyrene. Monomers for synthesizing the styrene copolymer may include, besides the above styrene monomers, acrylic acid, and acrylates such as methyl acrylate, ethyl acrylate, propyl acrylate, butyl acrylate, octyl acrylate, 2-ethylhexyl acrylate, n-tetradecyl acrylate, n-hexadecyl acrylate, lauryl acrylate, cyclohexyl acrylate, diethylaminoethyl acrylate and dimetylaminoethyl acrylate; methacrylic acid, and methacrylates such as methyl methacrylate, ethyl methacrylate, propyl methacrylate, butyl methacrylate, amyl methacrylate, hexyl methacrylate, 2-ethylhexyl methacrylate, octyl methacrylate, decyl methacrylate, dodecyl methacrylate, lauryl methacrylate, cyclohexyl methacrylate, phenyl methacrylate, 2-hydroxyethyl methacrylate, 2-hydroxypropyl methacrylate, dimethylaminoethyl methacrylate, glycidyl methacrylate and stearyl methacrylate. Other monomers that may be used may include, for example, acrylonitrile, 2-vinylpyridine, 4-vinylpyridine, vinylcarbazole, vinyl methyl ether, butadiene, isoprene, maleic anhydride, maleic acid, maleic acid monoesters, maleic acid diesters and vinyl acetate. Together with the styrene monomers, these monomers are used alone or in combination of two or more ones.

In addition to the binder resin components described above, the toner of the present invention may also contain any of the following compounds in an amount smaller than the content of the binder resin components. The compounds can be exemplified by silicone resins, polyester, polyurethane, polyamide, epoxy resins, polyvinyl butyral, rosin, modified rosin, terpene resins, phenol resins, aliphatic or alicyclic hydrocarbon resins, aromatic petroleum resins, chlorinated paraffin and paraffin wax.

The polyolefin used in the present invention may include homopolymers of α-olefins such as ethylene, propylene, 1-butane, 1-hexene and 4-methyl-1-pentene; copolymers of two or more kinds of α-olefins; and oxides of polyolefins. These polyolefins may also be vinyl type graft-modified polyolefins, which are graft-modified with vinyl monomers such as styrene.

The vinyl type graft-modified polyolefin comprises the polyolefin component as described above and a modification component. The modification component is grafted to the polyolefin component. As the modification component, a vinyl monomer is used, including, for example, as aliphatic vinyl monomers, methacrylic acid, methacrylates such as methyl methacrylate, ethyl methacrylate, propyl methacrylate, n-butyl methacrylate, isobutyl methacrylate, n-octyl methacrylate, 2-ethylhexyl methacrylate, lauryl methacrylate, stearyl methacrylate, dodecyl methacrylate, phenyl methacrylate, dimethylaminoethyl methacrylate, diethylaminoethyl methacrylate, 2-hydroxyethyl methacrylate, 2,2,2-trifluoroethyl methacrylate and glycidyl methacrylate; acrylic acid, acrylates such as methyl acrylate, ethyl acrylate, propyl acrylate, n-butyl acrylate, isobutyl acrylate, n-octyl acrylate, lauryl acrylate, stearyl acrylate, dodecyl acrylate, 2-ethylhexyl acrylate, phenyl acrylate, 2-chloroethyl acrylate, 2-hydroxyethyl acrylate, cyclohexyl acrylate, dimethylaminoethyl acrylate, diethylaminoethyl acrylate, dibutylaminoethyl acrylate, 2-ethoxy acrylate and 1,4-butanediol diacrylate; maleic acid, fumaric acid, itaconic acid, citraconic acid, monoethyl maleate, diethyl maleate, monopropyl maleate, dipropyl maleate, monobutyl maleate, dibutyl maleate, di-2-ethylhexyl maleate, monoethyl fumarate, diethyl fumarate, dibutyl fumarate, di-2-ethylhexyl fumarate, monoethyl itaconate, diethyl itaconate, monoethyl citraconate, and diethyl citraconate. These can be used alone or in combination of two or more kinds.

The graft modification components may also include, as aromatic vinyl monomers, styrene, o-methylstyrene, m-methylstyrene, p-methylstyrene, α-methylstyrene, 2,4-dimethylstyrene, p-ethylstyrene, p-n-butylstyrene, p-tert-butylstyrene, p-n-dodecylstyrene, p-phenylstyrene and p-chlorostyrene. These can be used alone or in combination of two or more kinds.

The polyolefin can be graft-modified using conventionally known methods. For example, the polyolefin, the aromatic vinyl monomer and the aliphatic vinyl monomer which are in the state of a solution or in a molten state may be reacted by heating in the atmosphere or under application of pressure end in the presence of a radical initiator. A graft-modified polyolefin can be thus obtained. The grafting using the aromatic vinyl monomer and the aliphatic vinyl monomer may be carried out simultaneously or separatedly.

The polyolefin used in the present invention should be a low molecular weight polyolefin preferably having a weight average molecular weight of from 2,000 to 30,000, and more preferably from 5,000 to 18,000, as measured by high-temperature GPC using orthodichlorobenzene as a solvent.

In the magnetic toner of the present invention, the polyolefin may preferably be added to the binder resin in an amount of from 0.1 part to 20 parts by weight, and more preferably from 0.1 part to 10 parts by weight, based on 100 parts by weight of the binder resin. When it is added in an amount less than 0.1 part by weight, it is difficult to effect anti-offset properties. When it is added in an amount more than 20 parts by weight, the particles of polyolefin that separate in the binder resin become large, resulting in a lowering of the anti-blocking properties of the toner.

In the present invention, the molecular weight distribution pattern in the chromatogram obtained by GPC is measured under the following conditions, using THF (tetrahydrofuran) as a solvent.

Columns are stabilized in a heat chamber of 40° C. To the columns kept at this temperature, THF as a solvent is passed at a flow rate of 1 ml per minute, and about 100 μl of THF sample solution is injected thereinto for measurement. In measuring the molecular weight of the sample, the molecular weight distribution of the sample is calculated from a calibration curve (the relationship between the logarithmic value of molecular weight and elution time) prepared using several kinds of monodisperse polystyrene standard samples. As the standard polystyrene samples used for the preparation of the calibration curve, it is suitable to use samples with molecular weights of from $10^2$ to $10^7$ which are available from Showa Denko KK. or Toso Co., Ltd., and to use at least about 10 standard polystyrene samples. As a detector, an RI (refractive index) detector is used. As columns, a combination of a plurality of commercially available polystyrene gel columns should be used. For example, they may preferably comprise a combination of Shodex GPC KF-801, KF-802, KF-803, KF804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H ($H_{XL}$), G6000H($H_{XL}$), G7000H($H_{XL}$) and TSK guard column, available from Toso Co., Ltd.

In the present invention, LC-GPC150 C (manufactured by Waters Inc.) is used as the GPC measuring apparatus, and Shodex KF-801, KF-802, KF803, KF-804, KF-805, KF-806, KF-807 and KF-800P (available from Showa Denko K.K.) are used as the columns.

The sample is prepared in the following way: The binder resin or the magnetic toner is put in THF, and is left to stand for several hours, followed by thorough shaking so as to be well mixed with the THF (until coelescent matters of the sample has disappeared), which is further left to stand for at least 12 hours. The sample should be left in THF for at least 24 hours in total. Thereafter, the solution having been passed through a sample-treating filter (pore size: 0.45 to 0.5 μm; for example, MAISHORI DISKH-25-5, available from Toso Co., Ltd. or EKICHRO DISK 25CR, available from German Science Japan, Ltd., can be utilized) to be used as the sample for GPC. The sample is so adjusted to have resin components in a concentration of from 3 to 7 mg/ml.

When the sample is prepared, components insoluble to THF are removed and components soluble in THF are measured by GPC.

In the present invention the whole molecular weight distribution measured by GPC of the binder resin means the molecular weight distribution measured on components having a molecular weight of not less than 500.

The content of the components with the molecular weights of from 500 to 100,000 can be calculated by comparing the weights of cuttings from the Gpc chromatogram, the weight of the region of a molecular weight of from 500 to 100,000 with the weight of the region of the molecular weight of 100,000 or more.

The content of the component with a molecular weight of 500,000 or more can be calculated by comparing the weight of a cutting from the region of a molecular weight of not less than 500,000 in a chromatogram obtained by GPC, with the weight of the portion of other regions. It can also be calculated by comparing the area of the molecular weight of not less than 500,000, with the areas of other regions.

The toner of the present invention further contains a magnetic material. The magnetic material contained in the magnetic toner of the present invention may include iron oxides such as magnetite, γ-iron oxide ferrite and iron-excess ferrite; metals such as iron, cobalt and nickel, or alloys of any of these metals with any of metals such as aluminum, cobalt, copper, lead, magnesium, tin, zinc, antimony, beryllium, bismuth, cadmium, calcium, manganese, selenium, titanium, tungsten and vanadium, and mixture of any of these.

These ferromagnetic materials may preferably be those having an average particle diameter of from 0.1 μm to 1 μm, and more preferably from 0.1 μm to 0.5 μm. The magnetic material may be contained in the magnetic toner in an amount of from 60 to 110 parts by weight based on 100 parts by weight of the resin component, and particularly preferably from 65 to 100 parts by weight based on 100 parts by weight of the resin component.

In the magnetic toner used in the present invention, a charge control agent may preferably be used by compounding it into toner particles (internal addition) or blending it with toner particles (external addition). The charge control agent enables the optimum electrostatic charge control in conformity with developing systems. Particularly in the present invention, it enables more stable balance between the binder resin and charging. A positive charge control agent may include Nigrosine and products modified with a fatty acid metal salt; quaternary ammonium salts such as tributylbenzylammonium 1-hydroxy-4-naphthoslulfonate and tetrabutylammonium teterafluoroborate; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds. Of these, Nigrosine type charge control agent or quaternary ammonium salt type charge control agents may particularly be preferabe.

Homopolymers of monomers represented by the following Formula:

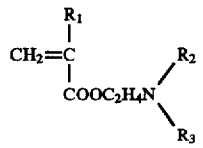

wherein $R_1$ represents H or $CH_3$; and $R_2$ and $R_3$ each represent a substituted or unsubstituted alkyl group, preferably $C_1$ to $C_4$ alkyl group, or copolymers of polymerizable monomers such as styrene, acrylates or methacrylates as described above may also be used as positive charge control agents. In this case, these charge control agents can also act as binder resins (as a whole or in part).

As a negative charge control agent usable in the present invention, for example, organic metal complex salts and chelate compounds are effective. In particular, acetylacetone metal complexes, salicylic acid type metal complexes, or salts thereof are preferred, as exemplified by aluminumacetylacetonato, iron (II) acetylacetonato, chromium 3,5-di-tert-butylsalicylate and zinc 3,5-di-tert-butylsalicylate. In particular, salicylic acid type metal complexes (including monoalkyl derivatives and dialkyl derivatives) and salicylic acid type metal salts (including monoalkyl derivatives and dialkyl derivatives) are preferred.

The charge control agents described above (those having no action as binder resins) may preferably be used in the form of fine particles. In this case, the charge control agent may preferably have a number average particle diameter of specifically 4 μm or less, and more preferably 3 μm or less.

When internally added to the toner, such a charge control agent may preferably be used in an amount of from 0.1 parts to 20 parts by weight, and more preferably from 0.2 parts to 10 parts by weight, based on 100 parts by weight of the binder resin.

The toner according to the present invention may be optionally mixed with various additives by internal addition or external addition. As a colorant, dyes and pigments conventionally known can be used, which may be used usually in an amount of from 0.5 parts to 20 parts by weight based on 100 parts by weight of the binder resin. Other additives may include lubricants such as zinc stearate; abrasives such as cerium oxide, silicon carbide and strontium titanate; fluidity-providing agents or anti-caking agents as exemplified by colloidal silica and aluminum oxide; and conductivity-providing agents as exemplified by carbon black and tin oxide.

The magnetic toner of the present invention can be produced by thoroughly mixing magnetic iron oxide and the binder resin containing the polyolefin, optionally together with the pigment or dye serving as a colorant, the charge control agent and other additives by means of a mixer such as a ball mill, melt-kneading them using a heat kneading machine such as a heat roller, a kneader or an extruder, to mutually compatibilize resins, dispersing or dissolving a pigment or dye in the kneaded product, and solidifying it by cooling, followed by pulverization and classification. Thus the magnetic toner according to the present invention can be obtained.

In the toner according to the present invention, a fine silica powder may be mixed by internal addition or external addition. It is preferable to mix it by external addition. When the magnetic toner is triboelectrically charged by bringing magnetic toner particles into contact with the surface of a cylindrical conductive sleeve having a magnetic field generating means in its inside, the increasing frequency of the contact between the toner particles and the sleeve surface tends to cause wear of toner particles. Combination of the magnetic toner of the present invention and the fine silica powder brings about a remarkable decrease in friction because of interposition of fine silica powder between the toner particles and the sleeve surface. This enables achievement of better running performance of the magnetic toner, and makes it possible to provide a developer having a much superior magnetic toner for a long time use.

The fine silica powder, can be produced by the dry process or by the wet process. In view of antifilming and running performance, it is preferred to use the dry process fine silica powder.

The dry process herein means a process for producing fine silica powder formed by vapor phase oxidation of a silicon halide. For example, it is a process that utilizes heat decomposition oxidation reaction in the oxyhydrogen of silicon tetrachloride gas. The reaction basically proceeds as follows.

$$SiCl_4+2H_2+O_2 \rightarrow SiO_2+4HCl$$

In this production step, it is also possible to use other metal halides such as aluminum chloride or titanium chloride together with the silicon halide to give a composite fine powder of silica. The fine silica powder of the present invention includes these too.

Commercially available fine silica powders usable in the present invention, produced by the vapor phase oxidation of the silicon halide, include, for example, those which are on the market under the following trade names:

Aerosil 130, 200, 300, 380, OX50, TT600, MOX80, MOX170, COK84 (Aerosil Japan, Ltd.);

Cab-O-SiL M-5, MS-7, MS-75, HS-5, EH-5 (CABOT CO.);

Wacker HDK N20, V15, N20E, T30, T40 (WACKER-CHEMIE GMBH);

D-C Fine Silica (Dow-Corning Corp.); and

Fransol (Franzil Co.).

The fine silica powder used in the present invention can be produced by the wet process, using conventionally known various methods. For example, there is a production method in which sodium silicate is decomposed using an acid, as shown by the following reaction scheme:

$$Na_2O.XSiO_2+HCl+H_2O \rightarrow SiO_2.nH_2O+NaCl$$

Besides, there are a method in which sodium silicate is decomposed using an ammonium salt or alkali salt, a method in which an alkaline earth metal silicate is produced from sodium silicate followed by decomposition using an acid to Give silicic acid, a method in which an aqueous sodium silicate solution is passed through an ion-exchange resin to Give silicic acid, and a method making use of naturally occurring silicic acid or silicate.

To the fine silica powder herein referred to it is possible to apply any of anhydrous silicon dioxide (colloidal silica), and other silicates such as aluminum silicate, sodium silicate, potassium silicate, magnesium silicate and zinc silicate.

Commercially available fine silica powders produced by the wet process include, for example, those which are on the market under the following trade names:

| | |
|---|---|
| Carplex | Shionogi & Co., Ltd. |
| Nipsil | Nippon Silica Industrial Co., Ltd. |
| Tokusil, Finesil | Tokuyama Soda Co., Ltd. |
| Vitasil | Taki Seihi Co. |
| Silton, Silnex | Mizusawa Industrial Chemicals, Ltd. |
| Starsil | Kamishima Kagaku Co. |
| Himesil | Ehime Yakuhin Co. |
| Sairoid | Fuji-Davison Chemical Ltd. |
| Hi-Sil | Pittsburgh Plate Glass Co. |
| Durosil | Fiillstoff-Gesellschaft Marquart |
| Ultrasil | " |
| Manosil | Hardman and Holden |
| Hoesch | Chemische Fabrik Hoesch K-G |

-continued

| | |
|---|---|
| Sil-Stone | Stone Rubber Co. |
| Nalco | Nalco Chemical Co. |
| Quso | Philadelphia Quartz Co. |
| Imsil | Illinis Minerals Co. |
| Calcium Silikat | Chemische Fabrik Hoesh K-G |
| Calsil | Füllstoff-Gesellschaft Marquart |
| Fortafil | Imperial Chemical Industries, Ltd. |
| Microcal | Joseph Crosfield & Sons, Ltd. |
| Manosil | Hardman and Holden |
| Vulkasil | Farbenfabiken Bryer, A.-G. |
| Tufknit | Durham Chemicals, Ltd. |
| Silmos | Shiraishi kogyo Kaisha, Ltd. |
| Starlex | Kamishima Kagaku Co. |
| Fricosil | Taki Seihi Co. |

Of the above fine silica powders, a fine silica powder having a surface specific area, as measured by the BET method using nitrogen absorption, of not less than 30 $m^2/g$, and particularly in the range of from 50 to 400 $m^2/g$, can give good results. The fine silica powder should preferably be used in an amount of from 0.01 parts to 8 parts by weight, and more preferably from 0.1 parts to 5 parts by weight, based on 100 parts by weight of the toner.

When the toner used in the present invention is used as a positively chargeable toner, a positively chargeable fine silica powder, rather than a negatively chargeable one, may be more preferable, since the charge stability is not disturbed.

As methods for obtaining the positively chargeable fine silica powder, there are a method in which the untreated fine silica powder as described above is treated with a silicone oil having an organo group which has at least one nitrogen atom on its side chain, and a method in which it is treated with a nitrogen-containing silane coupling agent, or a method in which it is treated with both of these.

In the present invention, the positively chargeable silica means that having a "plus" triboelectric charge with respect to iron powder carrier when measured by the blow-off method.

As the silicone oil having a nitrogen atom on the side chain for treating the fine silica powder, it is possible to use a silicone oil having at least a unit structure represented by the following formula:

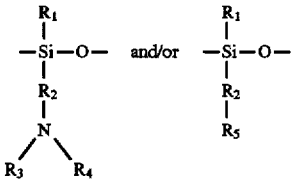

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic group.

In the above formula, the alkyl group, aryl group, alkylene group and phenylene group may each have an organo group having a nitrogen atom, or may have a substituent such as a halogen so long as the charge performance is not disturbed.

The nitrogen-containing silane coupling agent used in the present invention generally have a structure represented by the following formula:

$$R_m—Si—Y_n$$

wherein R represents an alkoxyl group or a halogen atom; Y represents an amino group or an organo group having at least one nitrogen atom; and m and n are each an integer of 1 to 3, provided that m+n=4.

The organo group having at least one nitrogen atom can be exemplified by an amino group having an organic group as a substituent, a nitrogen-containing heterocyclic group, or a group having a nitrogen-containing heterocyclic group. The nitrogen-containing heterocyclic group may include unsaturated heterocyclic groups or saturated heterocyclic groups, and known groups can be applied for these. The unsaturated heterocyclic groups can be exemplified by the following:

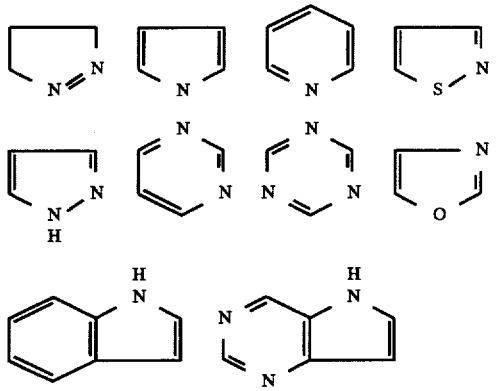

The saturated heterocyclic groups can be exemplified by the following:

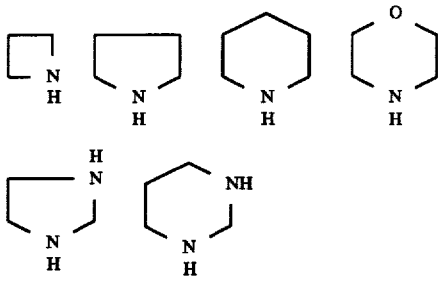

The heterocyclic groups used in the present invention should preferably be those of structure of 5 members or 6 members, taking account of stability.

Examples of such treating agents may be aminopropyltrimethoxysilane, aminopropyltriethoxysilane, dimethylaminopropyltrimethoxysilane, diethylaminopropyltriethoxysilane, dipropylaminopropyltrimethoxysilane, dibutylaminopropyldimethoxysilane, monobutylaminopropyltriethoxysilane, dioctylaminopropyltriethoxysilane, dibutylaminopropyltrimethoxysilane, dibutylaminopropylmonomethoxysilane, dimethylaminophenyltriethoxysilane, trimethoxysilyl-γ-propylphenylamine and trimethoxysilyl-γ-propylbenzylamine. As the nitrogen-containing heterocylic group, those having the above structure can be used. Examples of such compounds may be methoxysilyl-γ-propylpiperidine, trimethoxysilyl-γ-propylmorphorine and trimethoxysilyl-γ-propylimidazole.

These treated positively chargeable fine silica powder can be effective when it is applied in an amount of from 0.01 parts to 8 parts by weight based on 100 parts by weight of the toner, and, in particular, can exhibit positive chargeability with an excellent stability when added in an amount of from 0.1 parts to 5 parts by weight. As to a preferred embodiment for the mode of addition, a preferable state is that the treated fine silica powder added in an amount of from 0.1 parts to 3 parts by weight based on 100 parts by weight of the toner is deposited to the toner particle surfaces. The untreated fine silica powder may also be used in the same amount.

The fine silica powder used in the present invention may be optionally treated with a treating agent such as a silane coupling agent or an organic silicon compound for the purpose of making the powder hydrophobic, which treating agent reacts with or is physically absorbed by the fine silica powder. Such a treating agent may include, for example, hexamethylsilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, tirorganosilyl mercaptan, trimethylsilyl mercaptan, tirorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyl-disiloxane, and a dimethylpolysiloxane containing 2 to 12 siloxane units and a hydroxyl group bonded to each Si in its units positioned at the terminals. Any of these may be used alone or in the form of a mixture of two or more kinds.

It is also possible to add to the magnetic toner of the present invention a fine powder of fluorine-containing polymer as exemplified by a fine powder of polytetrafluoroethylene, polyvinylidene fluoride or a tetrafluoroethylene-vinylidene fluoride copolymer. In particular, fine polyvinylidene fluoride powder is preferred in view of fluidity and abrasive properties. Such a powder may preferably be added to the toner in an amount of from 0.01% to 2.0% by weight, and particularly from 0.02% to 1.0% by weight.

In particular, although the mechanism is unclear, when the fine powder described above is externally added to the magnetic toner with the fine silica powder, the stabilization of the silica deposited to the toner can be obtained, so that the silica deposited thereto no longer becomes separate from the toner not causing wear of the toner or staining of the sleeve, making it possible to more increase the charge stability.

Figure 2:
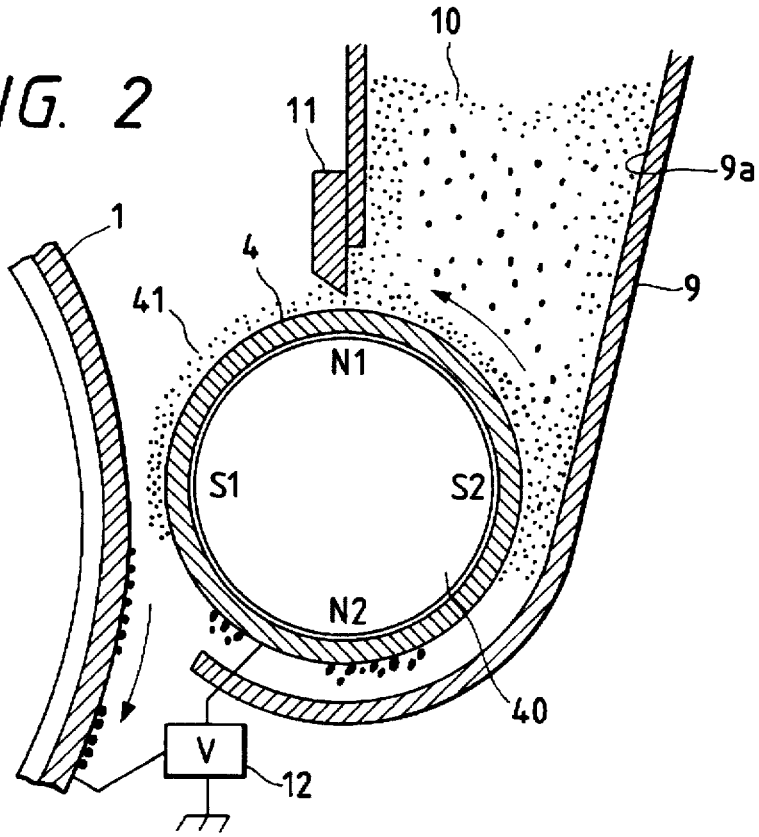
FIG. 2 is a partially enlarged view of FIG. 1 to illustrate a developing process.

An example of specific apparatus usable for carrying out an image forming process in the present invention will be described below with reference to FIG. 1 and FIG. 2 which is an enlarged view of FIG. 1.

Reference numeral 2 denotes a corona assembly which is a means for electrostatically charging a photosensitive drum 1. It, for example, charges the photosensitive drum to the negative polarity so that an electrostatic latent image is formed thereon upon exposure. The latent image thus formed is developed using a positively chargeable magnetic toner 10 of the present invention, held in a developing assembly 9 equipped with a magnetic blade 11 made of iron and a non-magnetic developing sleeve 4 in which a magnet 40 is provided, serving as a developer carrying member. The developing sleeve 4 is comprised of a stainless steel sleeve (SUS304) sandblasted with Carborundum #400. In the developing zone, an AC bias, a pulse bias and/or a DC bias is/are applied across a conductive substrate of the photosensitive drum and the developing sleeve 4 through a bias applying means 12. A transfer sheet P is fed and delivered to a transfer zone, where the transfer sheet P is electrostatically charged from its back surface by a transfer corona assembly 3 having a voltage applying means 14, so that the developed image (toner image) on the surface of the photosensitive drum 1 is electrostatically transferred to the transfer sheet P. The transfer sheet P separated from the photosensitive drum 11 is subjected to fixing using a heat-pressure roller fixing unit 7 so that the toner image on the transfer sheet P can be fixed.

The magnetic toner remaining on the photosensitive drum 1 after the transfer step is removed by the operation of a cleaning assembly 8 having a cleaning blade. After the cleaning, the residual charges on the surface of the photosensitive drum 1 is eliminated by erase exposure 6, and thus the procedure again starts from the charging step using the corona assembly 2.

The basic constitution and characteristic features of the present invention have been described above. The present invention will now be described below by giving Examples. These by no means limit the present invention. In the following formulation, "parts(s)" refers to "part(s) by weight"

EXAMPLE 1

In a four-necked flask equipped with a nitrogen gas guide pipe, a condenser, a stirrer and a thermometer, 200 parts of ion-exchanged water, 80 parts of styrene, 20 parts of n-butyl acrylate and 0.4 part of 1,4-bis(t-butylperoxycarbonyl) cyclohexane (HTP) as a polymerization initiator were put, and suspension polymerization was carried out at a polymerization temperature of 90° C. for 24 hours. Thereafter, the reaction mixture was cooled, washed with water and dried to give a high molecular weight polymer (resin P). In 1,000 parts of methyl ethyl ketone, 100 parts of this high molecular weight polymer was dissolved, and thereafter ethanol was dropwise added in the resulting solution until the high molecular weight polymer component was precipitated by 95% by weight. The precipitated high molecular weight polymer component was washed with water and then dried to give binder resin component I. The molecular weight distribution of this binder resin component I was measured by GPC to reveal that as shown in Table 1 it had a peak distribution (P2) at a molecular weight of 630,000 and the ratio of the components having molecular weight of from 500 to 100,000 was 12.0%.

Next, in a four-necked flask equipped with a nitrogen gas guide pipe, a condenser, a stirrer and a thermometer, 800 parts of xylene was put, which was then stirred under a nitrogen gas stream and maintained at 90° C. A mixture of 83 parts of styrene, 17 parts of n-butyl acrylate and 4.3 parts of di-t-butyl peroxide (DTBP) as a polymerization initiator was dropwise added thereto over a period of 6 hours using a continuous dropping device, and solution polymerization was carried out to give a solution in which a low molecular weight polymer, binder resin component B, had been dissolved. The molecular weight distribution of the binder resin component B was measured by GPC to reveal that as shown in Table 1 it had a peak distribution (P1) at a molecular weight of 12,000 and its Mw/Mn was 1.95.

To the above solution (containing 60 parts of binder resin component B), 40 parts of binder resin component I and 4 parts of low molecular weight polypropylene (weight average molecular weight: about 10,000) were added, and dissolved and mixed therein with thorough stirring at 100° C. for about 4 hours, followed by removal of xylene. A final binder resin for toner was thus obtained.

Based on 100 parts of the above binder resin for toner, the following materials were well blended using a blender.

| | |
|---|---|
| Triiron tetraoxide (average particle diameter: 0.2 μm) | 80 parts |
| Nigrosine | 2 parts |

Thereafter, the blend was kneaded using a twin-screw kneading extruder kept at 80° C. The resulting kneaded product was cooled, and then crushed with a cutter mill, followed by pulverization using a fine grinding machine using a jet stream. The finely powdered product thus obtained was classified using a multi-division classifier making utilization of the Coanda effect, to give a positively chargeable magnetic fine black powder (magnetic toner) with a volume average particle diameter of 8.5 μm.

To 100 parts of the magnetic toner obtained, 0.6 part of positively chargeable hydrophobic dry process fine silica powder (BET specific surface area: 200 $m^2/g$) and 0.1 part of fine polyvinylidene fluoride powder were added, which were blended using a Henschel mixer to give a positively chargeable insulating magnetic toner having silica particles on the magnetic toner particle surfaces.

Figure 3:
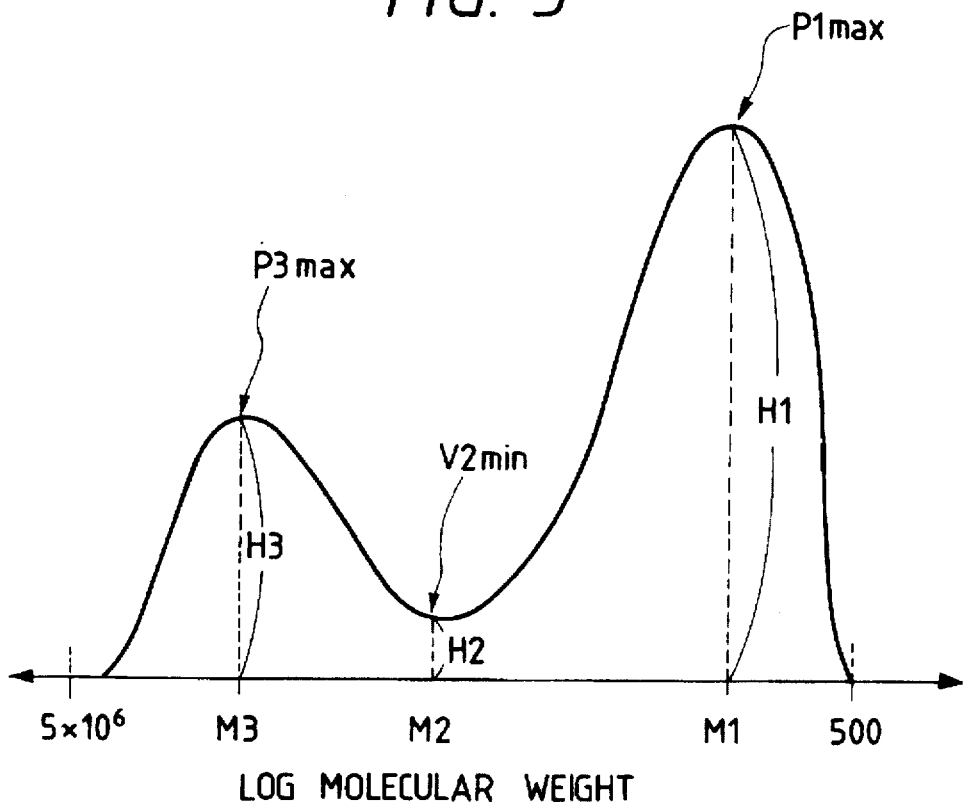
FIG. 3 illustrates a molecular weight distribution pattern measured by GPC of the binder resin in the magnetic toner of Example 1.

The molecular weight distribution of the binder resin for the above magnetic toner was measured by GPC under the following measuring conditions go obtain the results as shown in FIG. 3.

GPC measuring conditions

Apparatus: LC-GPC 150C (manufactured by Waters Inc.)

Columns: Shodex KF-801, KF-802, KF-803, KF-804, KF805, KF-806, KF-807 and KF-800P (Showa Denko K.K.)

Temperature: 40° C.

Solvent: Tetrahydrofuran (THF)

Flow rate: 1.0 ml/min

Sample: A sample with a sample concentration of 3 to 7 mg/ml was injected in an amount of 0.1 ml.

As a result, the peak (P1max) was at a molecular weight of 12,000; the peak (P3max) was at a molecular weight of 630,000; and the height H1 of the peak P1max in the low molecular weight region, the height H3 of the peak P3max in the high molecular weight region and the height H2 of the minimal point V2min between both the peaks were in a ratio H1:H2:H3 of 9.5:1:4.5; and the Mw/Mn was 28.0.

In the developing assembly of a modified machine of an electrophotographic copier NP4835 (manufactured by Canon Inc.) from which its fixing assembly was removed, the above magnetic toner was loaded, and unfixed images were obtained. Meanwhile, the fixing assembly removed from the copier NP4835 was modified to be usable as a temperature-variable, heat-pressure roller type external fixing assembly. Using this fixing assembly, a fixing test and an offset test were made on the unfixed images.

The external fixing assembly was set to have a nip width of 4.0 mm and a process speed of 150 mm/s, and its temperatures were conditioned at intervals of 5° C. within the temperature range of from 100° C. to 240° C., where the unfixed images were fixed at each temperature. Fixed images thus obtained were rubbed with a lens cleaning paper "Dusper" (trade name; available from OZU paper Go., Ltd.) under application of a load of 50 $g/cm^2$. A fixing temperature at which image density after the rubbing decreased by 2% or less was regarded as fixable temperature (temperature at which images become fixable). As a result, the fixable temperature was as low as 160° C., showing that the toner had a superior low-temperature fixing performance. Offsetting temperature (temperature at which offset begins to occur) was as high as 240° C. or more, showing that the toner had superior anti-offset properties. An image reproduction test was also carried out using an electrophotographic copier NP3725 (manufactured by Canon Inc.) having a developing sleeve having been blasted with amorphous particles, and the state of staining on the surface of the developing sleeve was observed. A running test was also carried out continuously making image reproduction 5,000 times. Both images formed at the initial stage and upon running on 5,000 sheets had a high image density Dmax and were fog-free and sharp, showing a high image quality, without causing no stain due to toner on the surface of the developing sleeve.

The above magnetic toner was left to stand at 50° C. in a dryer for 2 weeks to test anti-blocking properties of the toner. As a result, there was no problem at all.

Then the resulting toner was observed using a polarization microscope to confirm that the release agent was uniformly dispersed in toner particles and no free particles of the release agent were seen at all between toner particles.

Results obtained are shown in Table 2.

Comparative Example 1

A magnetic toner was produced in the same manner as in Example 1 except that the binder resin component B (as the low molecular weight polymer component) and the binder resin component I (as the high molecular weight polymer component) were mixed in amounts of 90 parts and 10 parts, respectively. Evaluation was also made in the same manner.

Comparative Example 2

A magnetic toner was produced in the same manner as in Example 1 except that only the low molecular weight polymer component, binder resin component B, was used as the binder resin component for toner in an amount of 100 parts. Evaluation was also made in the same manner.

Results of Comparative Examples 1 and 2 are shown in Table 2. Compared with Example 1, both Comparative Examples showed the same or better performance with regard to fixing performance but were greatly poor with respect to offsetting temperature, and were not preferable for practical use. With regard to image quality at the initial stage and after running on 5,000 sheets and anti-blocking properties, both Comparative Examples were inferior to Example 1. Comparative Example 1 showed a little better results than Comparative Example 2. This was presumably due to the addition of the high molecular weight polymer component, which brought about an improvement in the dispersibility of the release agent. To confirm this fact, the toners of Comparative Examples 1 and 2 were observed using a polarization microscope. As a result, in Comparative Example 2 free particles of the release agent were present between toner particles in a larger quantity than in Comparative Example 1.

Comparative Example 3

A magnetic toner was produced in the same manner as in Example 1 except that the resin P itself as shown in Table 1, which was used for preparing the binder resin component I by fractional precipitation, was used as the high molecular weight polymer component. Evaluation was also made in the same manner. Results obtained are shown in Table 2. Compared with Example 1 described above, the fixable temperature became as high as 170° C. and the offsetting temperature became as low as 220° C. This was presumably due to an increase in components present in intermediate molecular weight regions, not contributing the fixing and anti-offset, which caused poor fixing assembly and anti-offset properties. There were no problems with regard to image characteristics and anti-blocking properties.

Next, polymers A, C to H and J to O as shown in Table 1, comprised of a styrene-n-butyl acrylate copolymer, were prepared in the same manner as in Example 1 but changing the type and amount of the polymerization initiator, the type of the solvent, the polymerization temperature and so forth, and were used in the following Comparative Examples and Examples.

Comparative Example 4

Figure 4:
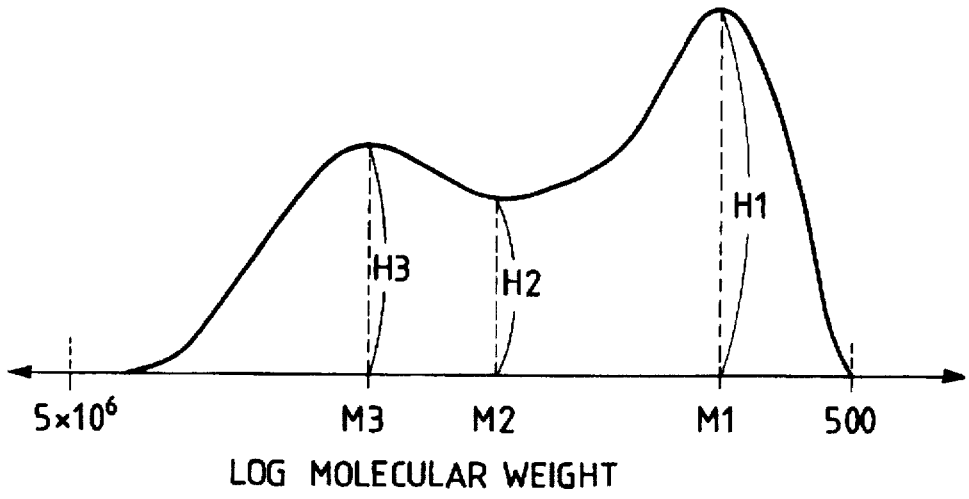
FIG. 4 illustrates a molecular weight distribution pattern measured by GPC of the binder resin in the magnetic toner of Comparative Example 1.

A binder resin was produced and subsequently a magnetic toner was prepared in the same manner as in Example 1 except that the resin O as shown in Table 1, obtained using 0.4 part of BPO (benzoyl peroxide) as a polymerization initiator, was used as the high molecular weight polymer component as it was, without carrying out the fractional precipitation. Evaluation was also made in the same manner. The molecular weight distribution of the binder resin, measured in the same manner as in Example 1, is shown in FIG. 4. As a result of the evaluation, as shown in Table 2, slight fogging was observed even on images at the initial stage, and extreme fogging was seen on images after Punning of image reproduction of 5,000 sheets. With regard to fixing assembly also, the fixable time became as high as 170° C., showing no good low-temperature fixing performance. As a result of the offset test, the offsetting temperature was 200° C., which was inferior to that of Example 1. In the evaluation of anti-blocking properties, heavy agglomeration of the toner occurred compared with Example 1 described above. This was presumably caused by the poor dispersibility of the release agent because the peak P3max is exist at much lower molecular weight in the high molecular weight region.

Example 2

A magnetic toner was produced in the same manner as in Example 1 except that a low molecular weight polymer solution containing binder resin component D was used. Evaluation was also made in the same manner.

Example 3

A magnetic toner was produced in the same manner as in Example 1 except that a low molecular weight polymer solution containing binder resin component E was used. Evaluation was also made in the same manner.

Results obtained in Examples 2 and 3 are shown in Table 2. Compared with Example 1, the offsetting temperature, the anti-blocking properties and the image characteristics after 5,000 sheet running were slightly lowered in Example 2, and the fixable temperature, in Example 3. However, good results were obtained.

Comparative Example 5

A magnetic toner was produced in the same manner as in Example 1 except that a low molecular weight polymer solution containing binder resin component F was used. Evaluation was also made in the same manner.

Comparative Example 6

A magnetic toner was produced in the same manner as in Example 1 except that a low molecular weight polymer solution containing binder resin component G was used. Evaluation was also made in the same manner.

Results obtained in Comparative Examples 5 and 6 are shown in Table 2. Compared with Example 1, the offsetting temperature, the image characteristics after 5,000 sheet running and the anti-blocking properties were greatly lowered in Comparative Example 5, and the fixing performance, in Comparative Example 6.

Example 4

A magnetic toner was produced in the same manner as in Example 1 except that binder resin K was used as the high molecular weight polymer component. Evaluation was also made in the same manner.

Example 5

A magnetic toner was produced in the same manner as in Example 1 except that binder resin L was used as the high molecular weight polymer component. Evaluation was also made in the same manner.

Results obtained in Examples 4 and 5 are shown in Table 2. Compared with Example 1, the offsetting temperature was slightly lowered in Example 4, and the fixable temperature, in Example 5, but not on the level particularly questioned. Other performances were as good as those in Example 1.

Comparative Example 7

A magnetic toner was produced in the same manner as in Example 1 except that binder resin M was used as the high molecular weight polymer component. Evaluation was also made in the same manner.

Comparative Example 8

A magnetic toner was produced in the same manner as in Example 1 except that binder resin N was used as the high molecular weight polymer component. Evaluation was also made in the same manner.

Results obtained in Comparative Examples 7 and 8 are shown in Table 2. Compared with Example 1, the offsetting temperature and the anti-blocking properties were greatly inferior in Comparative Example 7, and the fixing performance, in Comparative Example 8.

Example 6

A magnetic toner was produced in the same manner as in Example 1 except that into a solution containing binder resin C as the low molecular weight polymer component binder resin H used as the high molecular weight polymer component was added so that the resin C and resin H were contained 50 parts to 50 parts as binder resin components. Evaluation was also made in the same manner.

Example 7

A magnetic toner was produced in the same manner as in Example 1 except that a solution containing binder resin A as the low molecular weight polymer component and binder resin I used as the high molecular weight polymer component were mixed so that the resin A and resin I were contained in amounts of 70 parts and 30 parts respectively, as binder resin components. Evaluation was also made in the same manner.

Results obtained in Examples 6 and 7 are shown in Table 2. Compared with Example 1, the offsetting temperature, the image characteristics after running on 5,000 sheets and the anti-offset properties were slightly lowered in Example 7, results of which, however, were good. Other performances were as good as those in Example 1.

Comparative Example 9

A magnetic toner was produced in the same manner as in Example 1 except that a solution containing binder resin E as the low molecular weight polymer component and binder resin H used as the high molecular weight polymer component were mixed so that the resin E and resin H were contained in amounts of 35 parts and 65 parts respectively, as binder resin components. Evaluation was also made in the same manner.

Comparative Example 10

A magnetic toner was produced in the same manner as in Example 1 except that a solution containing binder resin D as the low molecular weight polymer component and binder resin L used as the high molecular weight polymer component were mixed so that the resin D and resin L were contained in amounts of 65 parts and 35 parts respectively, as binder resin components. Evaluation was also made in the same manner.

Results obtained in Comparative Examples 9 and 10 are shown in Table 2. Compared with Example 1, the fixing performance was greatly inferior in Comparative Example 9, and the offsetting temperature, so the image characteristics at the initial stage and after running on 5,000 sheets and the anti-blocking properties, in Comparative Example 10.

Example 8

A magnetic toner was produced in the same manner as in Example 1 except that a solution containing binder resin B as the low molecular weight polymer component and binder resin H used as the high molecular weight polymer component were mixed so that the resin B and resin H were in amounts of 65 parts and 35 parts, respectively, as binder resin components. Evaluation was also made in the same manner.

Example 9

A magnetic toner was produced in the same manner as in Example 1 except that a solution containing binder resin A as the low molecular weight polymer component and binder resin J used as the high molecular weight polymer component were mixed so that the resin A and resin J were contained in amounts of 35 parts and 65 parts respectively, as binder resin components. Evaluation was also made in the same manner.

Results obtained in Examples 8 and 9 are shown in Table 2. Although compared with Example 1, the offsetting temperature, the image characteristics after running on 5,000 sheets and the anti-offset properties slightly lowered in Example 8, and the fixable temperature, in Example 9, the results were excellent. Other performances were as excellent as those in Example 1.

Comparative Example 11

A magnetic toner was produced in the same manner as in Example 1 except that a solution containing binder resin A as the low molecular weight polymer component and binder resin K used as the high molecular weight polymer component were mixed so that the resin A and resin K were contained in amounts of 70 parts and 30 parts respectively, as binder resin components. Evaluation was also made in the same manner.

Comparative Example 12

A magnetic toner was produced in the same manner as in Example 1 except that a solution containing binder resin A as the low molecular weight polymer component and binder resin L used as the high molecular weight polymer component were mixed so that the resin A and resin L were contained in amounts of 30 parts and 70 parts respectively, as binder resin components. Evaluation was also made in the same manner.

Results obtained in Comparative Examples 11 and 12 are shown in Table 2. Compared with Example 1, the offsetting temperature, the image characteristics at the initial stage and after running on 5,000 sheets and the anti-blocking properties greatly lowered in Comparative Example 11, so the fixing performance, in Comparative Example 12.

Example 10

A magnetic toner was produced in the same manner as in Example 1 except that a solution containing binder resin E as the low molecular weight polymer component and binder resin H used as the high molecular weight polymer component were mixed so that the resin E and resin H were contained in amounts of 70 parts and 30 parts respectively, as binder resin components. Evaluation was also made in the same manner.

Example 11

A magnetic toner was produced in the same manner as in Example 1 except that a solution containing binder resin E as the low molecular weight polymer component and binder resin L used as the high molecular weight polymer component were mixed so that the resin E and resin L were contained in amounts of 35 parts and 65 parts respectively, as binder resin components. Evaluation was also made in the same manner.

Results obtained in Examples 10 and 11 are shown in Table 2. Although compared with Example 1, the offsetting temperature, the image characteristics after running on 5,000 sheets and the anti-offset properties were slightly lowered in Example 11, the fixable temperature was 5° higher and in Example 11, and the results were still excellent. Other performances were as excellent as those in Example 1.

Comparative Example 13

A magnetic toner was produced in the same manner as in Example 1 except that a solution containing binder resin E as the low molecular weight polymer component and binder resin K used as the high molecular weight polymer component were mixed so that the resin E and resin K were contained in amounts of 75 parts and 25 parts respectively, as binder resin components. Evaluation was also made in the same manner.

Comparative Example 14

A magnetic toner was produced in the same manner as in Example 1 except that a solution containing binder resin B as the low molecular weight polymer component and binder resin L used as the high molecular weight polymer component were mixed so that the resin B and resin L were contained in amounts of 25 parts and 75 parts respectively, as binder resin components. Evaluation was also made in the same manner.

Results obtained in Comparative Examples 13 and 14 are shown in Table 2. Compared with Example 1, the offsetting temperature, the image characteristics at the initial stage and after running on 5,000 sheets and the anti-blocking properties in Comparative Example 13, and the fixing performance, in Comparative Example 14 were greatly inferior.

Example 12

A magnetic toner was produced in the same manner as in Example 1 except that the low molecular weight polypropylene used therein was not previously added but added in the step of roughly mixing as with the materials such as the triiron tetraoxide and Nigrosine. Evaluation was also made in the same manner. Compared with Example 1, the image characteristics (fogging), the anti-offset properties and the anti-blocking properties were slightly poor. To investigate the reason why the anti-blocking properties was slightly poor, the toner before use in the processing was observed using a polarization microscope to reveal that a number of free particles of the release agent were present between toner particles. Such free particles of the release agent are presumed to have caused slightly poor anti-blocking properties compared with Example 1.

TABLE 1

| Polymer | Peak value P1 ($\times 10^4$) | Mw/Mn | Component with molecular weight of >500,000 (%) |
|---|---|---|---|
| GPC of low molecular weight polymer | | | |
| A | 0.82 | 2.01 | 0 |
| B | 1.20 | 1.95 | 0 |
| C | 1.50 | 1.83 | 0 |
| D | 0.60 | 2.09 | 0 |
| E | 1.80 | 1.69 | 0 |
| F | 0.42 | 2.13 | 0 |
| G | 2.5 | 1.61 | 0 |

| Polymer | Peak value P1 ($\times 10^4$) | Component with molecular weight of 500 to 100,000 (%) | Component with molecular weight of >500,000 (%) |
|---|---|---|---|
| GPC of high molecular weight polymer | | | |
| H | 40.5 | 14.5 | 45.2 |
| I | 63.0 | 12.0 | 54.0 |
| J | 79.0 | 9.2 | 61.9 |
| K | 29.0 | 7.3 | 40.1 |
| L | 87.0 | 4.1 | 76.0 |
| M | 18.0 | 18.5 | 22.3 |
| N | 106.0 | 2.0 | 83.0 |
| O | 14.0 | 36.0 | 14.8 |
| P | 53.0 | 32.5 | 39.5 |

TABLE 2

| | Resin used and mix ratio | GPC of binder resin: Peak values P1 max ($\times 10^4$) | P3 max ($\times 10^4$) | Ratio of peak height H1:H2:H3 | Mw/Mn | (1) (%) | (2) (°C.) | (3) (°C.) | Image char. (Fogging): Initial | 5,000 sheets | (4) |
|---|---|---|---|---|---|---|---|---|---|---|---|
| Example: | | | | | | | | | | | |
| 1 | B:I = 60:40 | 1.2 | 63.0 | 9.5:1:4.5 | 28.0 | 19.3 | 160 | >240 | A | A | A |
| 2 | D:I = 60:40 | 0.60 | 63.0 | 12.3:1:5.1 | 30.8 | 19.2 | 155 | 235 | A | AB | AB |
| 3 | E:I = 60:40 | 1.8 | 63.0 | 7.9:1:4.1 | 27.5 | 19.4 | 165 | >240 | A | A | A |
| 4 | B:K = 60:40 | 1.2 | 29.0 | 6.4:1:3.7 | 24.3 | 7.5 | 155 | 235 | A | A | A |
| 5 | B:L = 60:40 | 1.2 | 87.0 | 11.8:1:4.9 | 37.3 | 21.8 | 165 | >240 | A | A | A |
| 6 | C:H = 50:50 | 1.5 | 40.5 | 4.3:1:3.5 | 34.3 | 18.9 | 165 | 240 | A | A | A |
| 7 | A:I = 70:30 | 0.82 | 63.0 | 22.0:1:5.1 | 26.3 | 14.2 | 150 | 230 | A | AB | AB |
| 8 | B:H = 65:35 | 1.2 | 40.5 | 6.5:1:2.1 | 24.7 | 11.8 | 155 | 230 | A | AB | AB |
| 9 | A:J = 35:65 | 0.82 | 79.0 | 13.4:1:10.7 | 48.5 | 27.6 | 165 | >240 | A | A | A |
| 10 | E:H = 70:30 | 1.8 | 40.5 | 7.3:1:3.1 | 19.5 | 5.8 | 155 | 230 | A | AB | AB |
| 11 | E:L = 35:65 | 1.8 | 87.0 | 10.3:1:7.8 | 61.0 | 29.9 | 165 | >240 | A | A | A |
| 12 | B:I = 60:40 | 1.2 | 63.0 | 9.5:1:4.5 | 28.0 | 18.6 | 160 | 225 | AB | B | B |
| Comparative Example: | | | | | | | | | | | |
| 1 | B:I = 90:10 | 1.2 | 63.0 | 29.9:1:1.4 | 10.2 | 4.0 | 155 | 185 | B | B | BC |
| 2 | B = 100 | 1.2 | — | — | 1.95 | 0.0 | 150 | 170 | BC | BC | C |
| 3 | B:P = 60:40 | 1.2 | 53.0 | 7.6:1:1.4 | 24.1 | 6.9 | 170 | 220 | A | A | A |
| 4 | B:O = 60:40 | 1.2 | 14.0 | 2.1:1:1.3 | 12.3 | 4.2 | 170 | 200 | B | BC | C |
| 5 | F:I = 60:40 | 0.42 | 63.0 | 14.5:1:5.7 | 33.5 | 19.1 | 155 | 205 | AB | B | B |
| 6 | G:I = 60:40 | 2.5 | 63.0 | 6.8:1:3.9 | 27.1 | 19.5 | 185 | >240 | A | A | A |
| 7 | B:M = 60:40 | 1.2 | 18.0 | 3.9:1:2.3 | 20.1 | 4.8 | 155 | 205 | A | A | B |
| 8 | B:N = 60:40 | 1.2 | 106 | 16.8:1:6.1 | 57.2 | 30.2 | 185 | >240 | A | A | A |
| 9 | E:H = 35:65 | 1.8 | 40.5 | 2.1:1:3.4 | 35.9 | 25.4 | 185 | >240 | A | A | A |
| 10 | D:L = 65:35 | 0.6 | 87.0 | 27.3:1:7.4 | 51.3 | 21.6 | 160 | 210 | B | B | BC |
| 11 | A:K = 70:30 | 0.82 | 29.0 | 8.3:1:1.2 | 22.3 | 7.9 | 160 | 210 | B | B | BC |

TABLE 2-continued

| | | GPC of binder resin | | | | | | | Image char. | | |
|---|---|---|---|---|---|---|---|---|---|---|---|
| | | Peak values | | Ratio of | | | | | (Fogging) | | |
| | Resin used and mix ratio | P1 max ($\times 10^4$) | P3 max ($\times 10^4$) | peak height H1:H2:H3 | Mw/Mn | (1) (%) | (2) (°C.) | (3) (°C.) | Initial | 5,000 sheets | (4) |
| 12 | A:L = 30:70 | 0.82 | 87.0 | 15.2:1:14.2 | 63.4 | 38.2 | 185 | >240 | A | A | A |
| 13 | E:K = 75:25 | 1.8 | 29.0 | 4.1:1:1.7 | 12.5 | 6.2 | 170 | 205 | A | BC | BC |
| 14 | B:L = 25:75 | 1.2 | 87.0 | 13.8:1:11.3 | 107 | 31.5 | 190 | >240 | A | A | A |

(1): Component with molecular weight of >500,000 in binder resin
(2): Fixable temperature
(3): Offsetting temperature
(4): Evaluation of anti-blocking (50° C., 2 weeks)

In Table 2, letter symbols "A", "AB" and so forth indicates the following:

Image characteristics A:

No fogging at all.

AB: Fogging slightly occurred.

B: Fogging greatly occurred.

BC: Fogging very greatly occurred.

Anti-blocking

No blocking at all.

AB: Slight blocking occurred.

B: Agglomeration a little occurred.

BC: Agglomeration considerably occurred.

C: Almost solidified.

CC: Completely solidified.

Comparative Example 15

A high molecular weight polymer Q was prepared in the same manner as the resin P in Example 1 except for using benzoyl peroxide as the polymerization initiator. The high molecular weight polymer Q thus obtained had a distribution peak (P2) at a molecular weight of 220,000, containing the component present in the region of a molecular weight of from 500 to 100,000 by 32, and the component present in the region of a molecular weight of not less than 500,000 by 11%, and had a value Mw/Mn of 1.7.

Next, a low molecular weight polymer R was prepared in the same manner as the resin B in Example 1 except for using benzoyl peroxide as the polymerization initiator. The low molecular weight polymer R thus obtained had a distribution peak (P1) at a molecular weight of 12,000, had a value Mw/Mn of 1.7, and contained substantially no component present in the region of a molecular weight of not less than 500,000.

To 300 parts of xylene, 66 parts of low molecular weight polymer R, 34 parts of high molecular weight polymer Q and 4 parts of low molecular weight polypropylene were added, and mixed therein while heating them to 100° C., followed by the removal of xylene. A binder resin was thus prepared.

The binder resin obtained had P1max at a molecular weight of 12,000, P3max at 220,000, H1:H2:H3 of 9.5:1:4.5 and Mw/Mn of 21, and contained 3% of the component present in the region of a molecular weight not less than 500,000.

Except for using this binder resin, a magnetic toner was produced in the same manner as in Example 1. An image reproduction test was also carried out in the same manner as in Example 1 to make evaluation. As a result, the fixable temperature was 160° C., but the offsetting temperature was 200° C., which was lower than that of Example 1. The temperature range in which heat-pressure fixing can be conducted in a good contition was narrow.

What is claimed is:

1. A magnetic toner comprising a binder resin and a magnetic material, said binder resin comprising a non-crosslinked styrene polymer, a non-crosslinked styrene copolymer or a mixture of these and a polyolefin, wherein:

said binder has, in its molecular weight distribution pattern measure by gel permeation chromatography (GPC), at least one maximal point (peak) in each region of a low molecular weight from 5,000 to 20,200 and of a high molecular weight from 200,000 to 1,000,000, where a height H1 of a maximum peak in the low molecular weight region, a height H3 of a maximum peak in the high molecular weight region and a height H2 of minimal point between both of said peaks satisfy the relationship H1:H2:H3 of 3–25:1:1.5–12 and has a weight average molecular weight Mw and a number average molecular weight Mn of a value Mw/Mn from 15 to 80 and said binder resin is a binder resin prepared by dissolving in a solvent a low molecular weight polymer or copolymer having in the molecular weight distribution pattern measured by GPC, a maximal point (peak) in the region of a molecular weight from 5,000 to 20,200 and having a value Mw/Mn of not more than 3.0, a high molecular weight polymer or copolymer having a maximal point (peak) in the region of a molecular weight from 200,000 to 1,000,000 and containing not more than 30% by weight of components having a molecular weight from 500 to 100,000, and said polyolefin; and removing said solvent therefrom.

2. The magnetic toner according to claim 1, wherein said binder resin has in its molecular weight distribution measured by GPC a value Mw/Mn of from 22 to 60.

3. The magnetic toner according to claim 1, wherein said binder resin has in its molecular weight distribution pattern measured by GPG a peak in each region of a low molecular weight of from 8,000 to 16,000 and of a high molecular weight of from 400,000 to 800,000.

4. The magnetic toner according to claim 1, wherein said binder resin has in its molecular weight distribution pattern measured by GPC the relationship H1:H2:H3 of 6–20:1:3–9.

5. The magnetic toner according to claim 1, wherein said binder resin has in its molecular weight distribution pattern measured by GPC a value Mw/Mn of from 22 to 60, and a maximal point (peak) in each region of a low molecular weight of from 8,000 to 16,000 and of a high molecular weight of from 400,000 to 800,000, where a height H1 of a maximum peak in the low molecular weight region, a height H3 of a maximum peak in the high molecular weight region and a height H2 of a minimal point between both of said peaks satisfy the relationship H1:H2:H3 of 6–20:1:3–9.

6. The magnetic toner according to claim 1, wherein said low molecular weight polymer or copolymer, said high molecular weight polymer or copolymer and said polyolefin are dissolved during heating.

7. The magnetic toner according to claim 1, wherein said low molecular weight polymer or copolymer is a polymer or copolymer prepared by solution polymerization.

8. The magnetic toner according to claim 1, wherein said low molecular weight polymer or copolymer is a polymer or copolymer prepared by solution polymerization, and the same solvent as used in said solution polymerization is used as said solvent for dissolving said high molecular weight polymer or copolymer and said polyolefin.

9. The magnetic toner according to claim 1, wherein said high molecular weight polymer or copolymer is a polymer or copolymer prepared by suspension polymerization.

10. The magnetic toner according to claim 1, wherein said high molecular weight polymer or copolymer is prepared by fractionation so as to contain said 30% or less by weight of the component with a molecular weight of from 500 to 100,000.

11. The magnetic toner according to claim 10, wherein said high molecular weight polymer or copolymer is prepared by fractional precipitation.

12. The magnetic toner according to claim 1, wherein said polyolefin is contained in an amount of from 0.1 part by weight to 20 parts by weight based on 100 parts by weight of said binder resin.

13. The magnetic toner according to claim 1, wherein said polyolefin is contained in an amount of from 0.1 part by weight to 10 parts by weight based on 100 parts by weight of said binder resin.

14. The magnetic toner according to claim 1, wherein said magnetic material is contained in an amount of from 60 parts by weight to 110 parts by weight based on 100 parts by weight of said binder resin.

15. The magnetic toner according to claim 1, wherein said magnetic material is contained in an amount of from 65 parts by weight to 100 parts by weight based on 100 parts by weight of said binder resin.

16. The magnetic toner according to claim 1, wherein said polyolefin has a weight average molecular weight of from 2,000 to 30,000.

17. The magnetic toner according to claim 1, wherein said polyolefin has a weight average molecular weight of from 5,000 to 18,000.

18. The magnetic toner according to claim 1, wherein said polyolefin comprises a polypropylene having a weight average molecular weight of from 2,000 to 30,000.

19. The magnetic toner according to claim 1, wherein said binder resin contains from 5% to 30% of a high molecular weight component present in the region of a molecular weight of not less than 500,000.

20. The magnetic toner according to claim 1, wherein said binder resin contains from 7% to 25% of a high molecular weight component present in the region of a molecular weight of not less than 500,000.

* * * * *

UNITED STATES PATENT AND TRADEMARK OFFICE

CERTIFICATE OF CORRECTION

PATENT NO. : 5,716,746

DATED : February 10, 1998

INVENTOR(S): YUSHI MIKURIYA ET AL.

It is certified that error appears in the above-identified patent and that said Letters Patent is hereby corrected as shown below:

COLUMN 1

Line 39, "high-speed" should read --high speed-;
Line 53, "on" should read --onto--;
Line 66, "a" should be deleted.

COLUMN 2

Line 11, "fixing performance of" should read --performance of fixing--;
Line 12, "no" should read --any--;
Line 22, "end" should read --and--;
Line 28, "and" should be deleted.

COLUMN 3

Line 1, "not still" should read --still not--;
Line 24, "comprised of" should read --it comprises--;
Line 57, "lessor" should read --lesser--.

COLUMN 4

Line 8, "V2 min" should read --V2min--;
Line 34, "these" should read --this--;
Line 43, "agent" should read --agent has--;
Line 54, "Also" should read --Also,--;
Line 55, "V2 min" should read --V2min--.

COLUMN 5

Line 50, "20,200" should read --20,000--;
Line 62, "poor undesirably" should read --undesirably poor--;
Line 67, "end" should read --and--.

UNITED STATES PATENT AND TRADEMARK OFFICE

CERTIFICATE OF CORRECTION

PATENT NO. : 5,716,746

DATED : February 10, 1998

INVENTOR(S): YUSHI MIKURIYA ET AL.

It is certified that error appears in the above-identified patent and that said Letters Patent is hereby corrected as shown below:

COLUMN 6

Line 6, "low molecular" should read --low molecular weight--;
Line 7, "peek" should read --peak--;
Line 37, delete "also as the good solvent used";
Line 47, "methoxy2,4—" should read --methoxy—2,4——.

COLUMN 7

Line 62, "dimetylaminoethyl" should read --dimethylaminoethyl--.

COLUMN 8

Line 10, "more ones." should read --more.--.

COLUMN 9

Line 1, "end" should read --and--;
Line 48, "KF803" should read --KF-803--;
Line 55, "coelescent matter of" should read --coalesced material in--;
Line 65, "to" should read --in--.

COLUMN 10

Line 7, "Gpc" should read --GPC--;
Line 27, "mixture" should read --mixtures--;
Line 47, "naphthoslulfonate" should read --naphthosulfonate--.

UNITED STATES PATENT AND TRADEMARK OFFICE

CERTIFICATE OF CORRECTION

PATENT NO. : 5,716,746

DATED : February 10, 1998

INVENTOR(S): YUSHI MIKURIYA ET AL.

It is certified that error appears in the above-identified patent and that said Letters Patent is hereby corrected as shown below:

COLUMN 12
Line 1, "powder," should read --powder--;
Line 25, "CO." should read --Co.--;
Line 42, "Give" should read --give--;
Line 44, "Give" should read --give--.

COLUMN 13
Line 5, "Illinis" should read --Illinois--;
Line 10, "Farbenfabiken" should read --Farbenfabriken--;
Line 12, "kogyo" should read --Kogyo--;
Line 62, "have" should read --has--.

COLUMN 14
Line 63, "These" should read --This--.

COLUMN 15
Line 46, "more" should read --further--.

COLUMN 16
Line 34, "in" should read --to--.

COLUMN 17
Line 29, "KF805" should read --KF-805--;
Line 59, "Go." should read --Co.--;

COLUMN 18
Line 11, "no" should read --any--;
Line 67, "the" should read --to the--.

UNITED STATES PATENT AND TRADEMARK OFFICE

CERTIFICATE OF CORRECTION

PATENT NO. : 5,716,746

DATED : February 10, 1998

INVENTOR(S): YUSHI MIKURIYA ET AL.

It is certified that error appears in the above-identified patent and that said Letters Patent is hereby corrected as shown below:

COLUMN 19

Line 1, "anti-offset" should read --anti-offset properties--; and delete "assembly";
Line 25, "Punning" should read --running--;
Line 35, "is exist" should read --exists--.

COLUMN 20

Line 51, "binder" should read --binder,--.

COLUMN 21

Line 31, "so" should read --as were--.

COLUMN 22

Line 22, "so" should read --as did--;
Line 50, "the" should read --and the--; and "and" should be deleted;
Line 51, "and" should be deleted; and "excellent" should read --good--;
Line 52, "excellent" should read --good--.

COLUMN 23

Line 26, "was" should read --were--.

COLUMN 25

Line 19, "cates" should read --cate--;
Line 26, "No" should read --A: No--;
Line 41, "32" should read --32%--.

UNITED STATES PATENT AND TRADEMARK OFFICE

CERTIFICATE OF CORRECTION

PATENT NO. : 5,716,746

DATED : February 10, 1998

INVENTOR(S): YUSHI MIKURIYA ET AL.

It is certified that error appears in the above-identified patent and that said Letters Patent is hereby corrected as shown below:

COLUMN 26

Line 20, "contition" should read --condition--;
Line 26, "measure" should read --measured--;
Line 28, "20,200" should read --20,000--;
Line 34, "minimal" should read --a minimal--;
Line 37, "80 and" should read 80, and--;
Line 43, "20,200" should read --20,000--.

Signed and Sealed this

Fifteenth Day of December, 1998

Bruce Lehman

*Attest:*

BRUCE LEHMAN

*Attesting Officer*

*Commissioner of Patents and Trademarks*